US006647854B1

(12) United States Patent
Stottlemyer et al.

(10) Patent No.: US 6,647,854 B1
(45) Date of Patent: Nov. 18, 2003

(54) DEVICE AND METHOD FOR NEUTRALIZATION OF UNDERWATER MINES

(75) Inventors: Thomas R. Stottlemyer, Mystic, CT (US); Michael P. Rousseau, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/244,927

(22) Filed: Sep. 12, 2002

(51) Int. Cl.[7] ..... B63G 7/02; B63G 7/06; B63G 7/08

(52) U.S. Cl. ..... 89/1.13; 102/402; 102/403

(58) Field of Search ..... 89/1.13; 102/402–403

(56) References Cited

U.S. PATENT DOCUMENTS 4,951,571 A * 8/1990 Bane ..... 102/402
4,970,957 A * 11/1990 Backstein et al. ..... 102/403
5,042,387 A * 8/1991 Backstein ..... 102/402
5,277,117 A * 1/1994 Bender et al. ..... 102/402
5,361,675 A * 11/1994 Spektor et al. ..... 89/1.13
5,708,230 A * 1/1998 Woodall et al. ..... 102/402
5,844,159 A * 12/1998 Posseme et al. ..... 89/1.13
6,286,431 B1 * 9/2001 Cangelosi ..... 102/402

FOREIGN PATENT DOCUMENTS

DE 4010686 A1 * 10/1991 ..... B63G/7/02
EP 308698 A1 * 3/1989 ..... B63G/7/02

* cited by examiner

*Primary Examiner*—Michael J. Carone
*Assistant Examiner*—Troy Chambers
(74) *Attorney, Agent, or Firm*—James M. Kasischke; Michael F. Oglo; Jean-Paul A. Nasser

(57) ABSTRACT

A method and device to neutralize influence mines has a control module to generate signals representative of acoustic and magnetic signatures of a ship. These representative signals will either detonate the threat mines or ensure that transiting ships will not set off the mines. An acoustic transducer array is coupled to the module to transmit acoustic signals representative of the acoustic portion of the signatures. A magnetic signal transmitter is coupled to the module to transmit magnetic signals representative of the magnetic portion of the signatures. An anchor is connected to the module, acoustic array, and magnetic signal transmitter to hold them at the ocean bottom, and a buoy is connected to the module, acoustic transducer array, and magnetic signal transmitter to hold the device vertically.

7 Claims, 3 Drawing Sheets

DEVICE AND METHOD FOR NEUTRALIZATION OF UNDERWATER MINES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to the neutralization of underwater mines. More particularly, this invention relates to a method and device for replicating acoustic and magnetic signatures of ships to neutralize threat mines that trigger due to influence of acoustic and/or magnetic signatures.

(2) Description of the Prior Art

Threats to shipping and naval operations caused by mines must be eliminated to allow effective operations and prevent losses. In the past contact and influence mines have caused significant amounts of damage to ships. In particular, mines have proven so effective because they are relatively inexpensive to build and deploy, and are extremely difficult to detect, classify, identify and neutralize. Traditionally, mines have been defeated by deploying search vehicles from vessels to locate them and by controlling the radiated signatures of naval ships. The problem with these techniques is that they require additional systems, such as divers with explosives, or helicopters dragging sweep systems along with separate monitoring facilities that require substantial time and logistic resources to implement.

Thus, in accordance with this inventive concept, a need has been recognized in the state of the art for a method and device to neutralize mines and ensure that mines will not detonate when a ship transits through a minefield.

SUMMARY OF THE INVENTION

The first object of the invention is to provide a method and device to neutralize mines.

Another object is to provide a method and device to deny an adversary the ability to effectively mine an area.

Another object is to provide a method and device to ensure that mines will not detonate when a ship transits through a minefield by transmitting signatures that are similar to the ship.

Another object is to provide a method and underwater device that replicates the acoustic and/or magnetic signatures of ships to neutralize the threat created by magnetic ande/or acoustic influence mines in a minefield.

Another object of the invention is to make the undersea environment an unreliable medium from which an enemy can successfully conduct mine and undersea waefare.

Another object of the invention is to provide a method and device to neutralize an area already having mines.

Another object is to provide a method and device to neutralize mines that is compact, lightweight, expendable, and easily deployed from multiple platforms.

These and other objects of the invention will become more readily apparent from the ensuing specification when taken in conjunction with the appended claims.

Accordingly, the present invention provides a method and underwater device for neutralizing influence mines and assuring that a ship will not detonate mines in an area. An electronics/control module within the device generates signals representative of acoustic and magnetic signatures of a ship. An acoustic transducer array is coupled to the module to transmit acoustic signals representative of the acoustic portion of the signature. A magnetic signal transmitter is coupled to the module to transmit magnetic signals representative of the magnetic portion of the signature. An anchor connected to the module, acoustic transducer array, and magnetic signal transmitter holds them at a bottom of a body of water. A buoy is connected to the top of the module, acoustic transducer array, and magnetic signal transmitter suspending them in the water and permitting transmission of the representative acoustic and magnetic signatures thereby destroying or neutralizing influence mines in the area.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENTS

Figure 1:
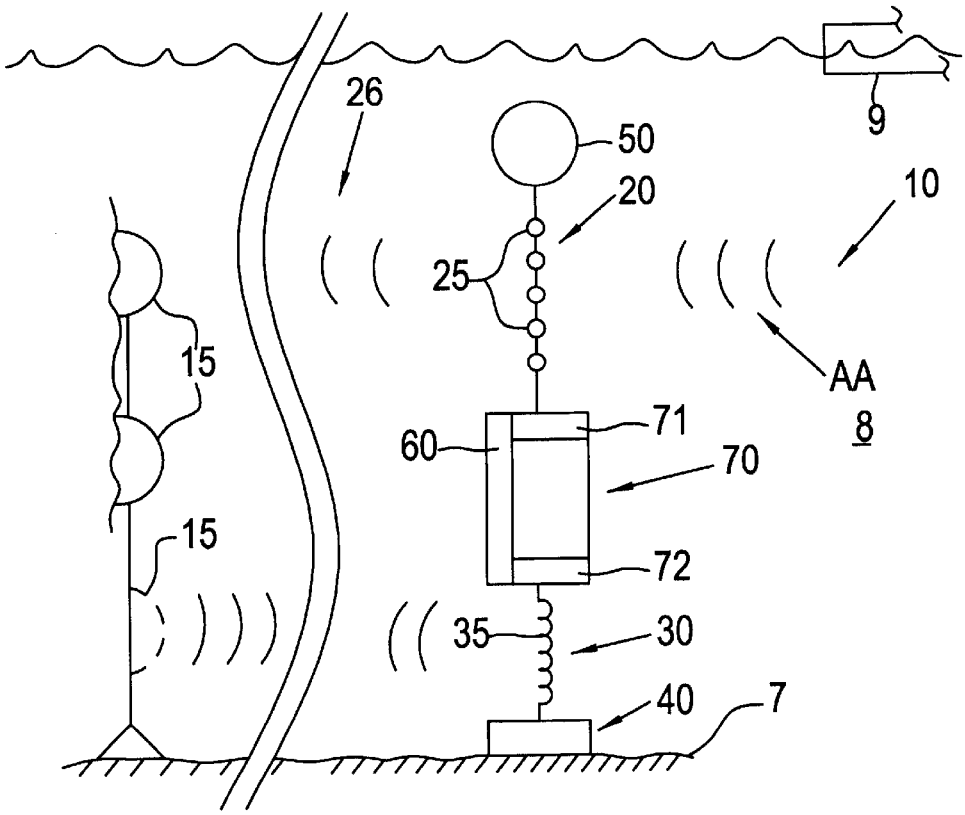
FIG. 1 is a schematic representation of one configuration of the device of the invention to neutralize mines and assure that a ship will not detonate mines.

Referring to FIG. 1 of the drawings, underwater neutralizing device 10 of this invention is deployed on the bottom 7 of a body of water 8, such as the ocean. Device 10 replicates and transmits signatures of a ship 9 to neutralize an adversary's influence mine 15 that detonates when it senses and recognizes such signatures transmitted to it through water 8. The signatures of ship 9 sensed by influence mine 15 can be made up of acoustic and/or magnetic portions unique to ship 9. Threat mine 15 will be neutralized by detonation when mine 15 senses the simulated signature signals transmitted from device 10. If mine 15 does not detonate when it receives the simulated signatures, it will be neutralized with respect to ship 9 since ship 9 will not activate it.

Device 10 is compact enough to be deployed in water 8 by a surface ship, submarine, or aircraft depending on the strategic and tactical situations. If it is known with certainty that there are no mines in the area, but the area could be mined later, a surface ship or submarine can be used to deploy one or more of devices 10. If there is a high probability that mines are already in an area, an aircraft can be used to deploy devices 10.

Device 10 has an acoustic transducer array 20 including at least one acoustic transducer 25 and a magnetic signal transmitter 30 including at least one magnetic coil 35 tethered to an anchor 40 and a buoyancy package, or buoy 50. Acoustic transducers 25 of acoustic transducer array 20 can operate in a receiver mode in addition to operating in the transmitter mode to enable activation of device 10 by acoustic signals AA from a remote station (not shown) or vessel 9. Acoustic and magnetic transmitters 20, 30 are connected to an energy source 60 that could be a thermal engine, battery pack, or fuel cell, for examples, to provide electrical power. Although energy source 60 is shown positioned between acoustic transmitter 20 and magnetic transmitter 30, source 60 could be located in anchor 40 and appropriately interconnected to transmitters 20, 30.

A control module 70 is connected to acoustic transmitter 20, magnetic transmitter 30, and energy source 60. Control module 70 has electronic sections 71, 72 generating appropriate driving signals representative of signatures of ship 9 for acoustic and/or magnetic transmitters 20, 30 so that transmitters 20, 30 respectively transmit representative acoustic signals 26 and/or magnetic signals 36. Acoustic transmitter 20 and magnetic transmitter 30 can be controlled by electronics/control module 70 to transmit in an omnidirectional or directional pattern as desired. Electronic sections 71, 72 of control module 70 can be preprogrammed to transmit either or both signals 26, 36 in one or more selective combinations from either or both of acoustic and magnetic transmitters 20, 30. This transmission of selective combinations of either or both of signals 20, 30 occurs after predetermined events happen. These events could be: 1.) passage of a period of time since deployment of device 10; 2.) reception of either of certain acoustic or magnetic information signals from nearby mine-laying, support, or escort craft in water 8; or 3.) reception of acoustic command signals AA from a remote control station or vessel by acoustic transducers 25. One or more of deployed devices 10 can be selectively activated by coded remote command signals AA at different times or for different time periods of activation, for example. Deployed devices could also transmit different signals representative of different ship signatures that might be passing through the area. All constituents of device 10 are environmentally resistant.

Components and connections for electronics/control module 70 and their appropriate interconnection to transmitters 20, 30 and energy source 60 are well known in the art. Off-the-shelf components for generating suitable signals at desired frequencies and discrete magnitudes to simulate the acoustic and magnetic signatures of a ship have long been available for selection and appropriate interconnection by one of ordinary skill in the art. Interfacing these simulated signals with typical arrangements for driving transmitters 20, 30 is well known. Therefore, one skilled in the art to which this invention pertains can choose and appropriately interconnect suitable components freely available in the art.

Device 10 of the invention is deployed in an area that has or may have at least one mine 15 that is activated and/or detonated by acoustic or magnetic signals. The size of an area that device 10 can effectively simulate signatures in, is a function of the levels of acoustic and magnetic signals that can be transmitted from it.

Acoustic and magnetic transmitters 20, 30 of one or more devices 10 will transmit acoustic and magnetic signals 26, 36 that are substantially the same as signatures of designated friendly ships that will be operating in an area where devices 10 are deployed.

Figure 2:
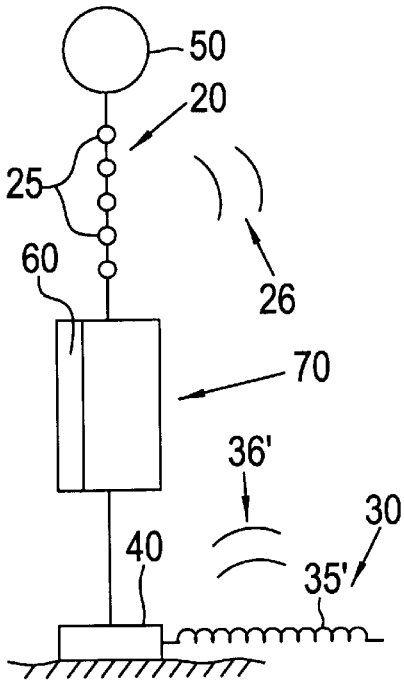
FIG. 2 is a schematic representation of another configuration of the device of the invention.

FIG. 2 represents an alternative embodiment of device 10 having coil 35' transmitting magnetic signals 36'. The main difference between the embodiments shown in FIGS. 1 and 2 is that the transmitted magnetic signals 36' will have different polarization and transmission properties that might affect some influence mines more effectively.

Figure 3:
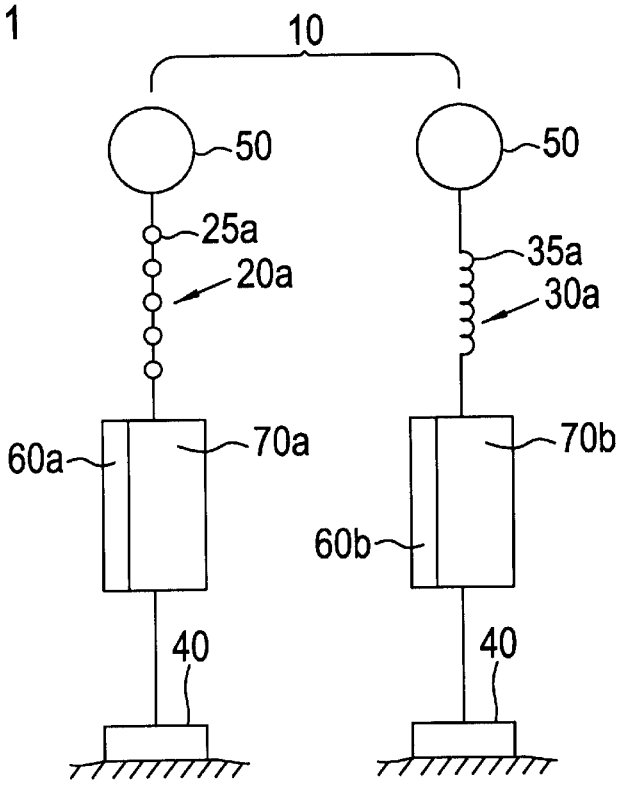
FIG. 3 is a schematic representation of yet anther configuration of the device of the invention to neutralize mines and assure that a ship will not detonate mines.

For some applications, however, neutralization device 10 can have an acoustic signal transmitter package 20*a* and a magnetic signal transmitter package 30*a* deployed separately from each other but in close proximity, see FIG. 3. Acoustic package 20*a* having acoustic transducers 25*a* and magnetic package 30*a* having magnetic coil 35*a* have separate energy sources 60*a*, 60*b* and electronics/control modules 70*a*, 70*b* for acoustic transducers 25*a* and magnetic coil 35*a*. Buoys 50 and anchors 40 locate and suspend these separated arrangements similar to FIGS. 1 and 2.

The embodiments of device 10 described above, have the capabilities to transmit pre-programmed patterns of acoustic/magnetic energy and can be turned on and off by a coded acoustic signal AA or in accordance with its predetermined operational schedule in electronics/control module 70. The ability of device 10 to turn on and off allows it to replicate multiple transiting ships or multiple transits of ship 9 to defeat mines that have ship counters.

Figure 4:
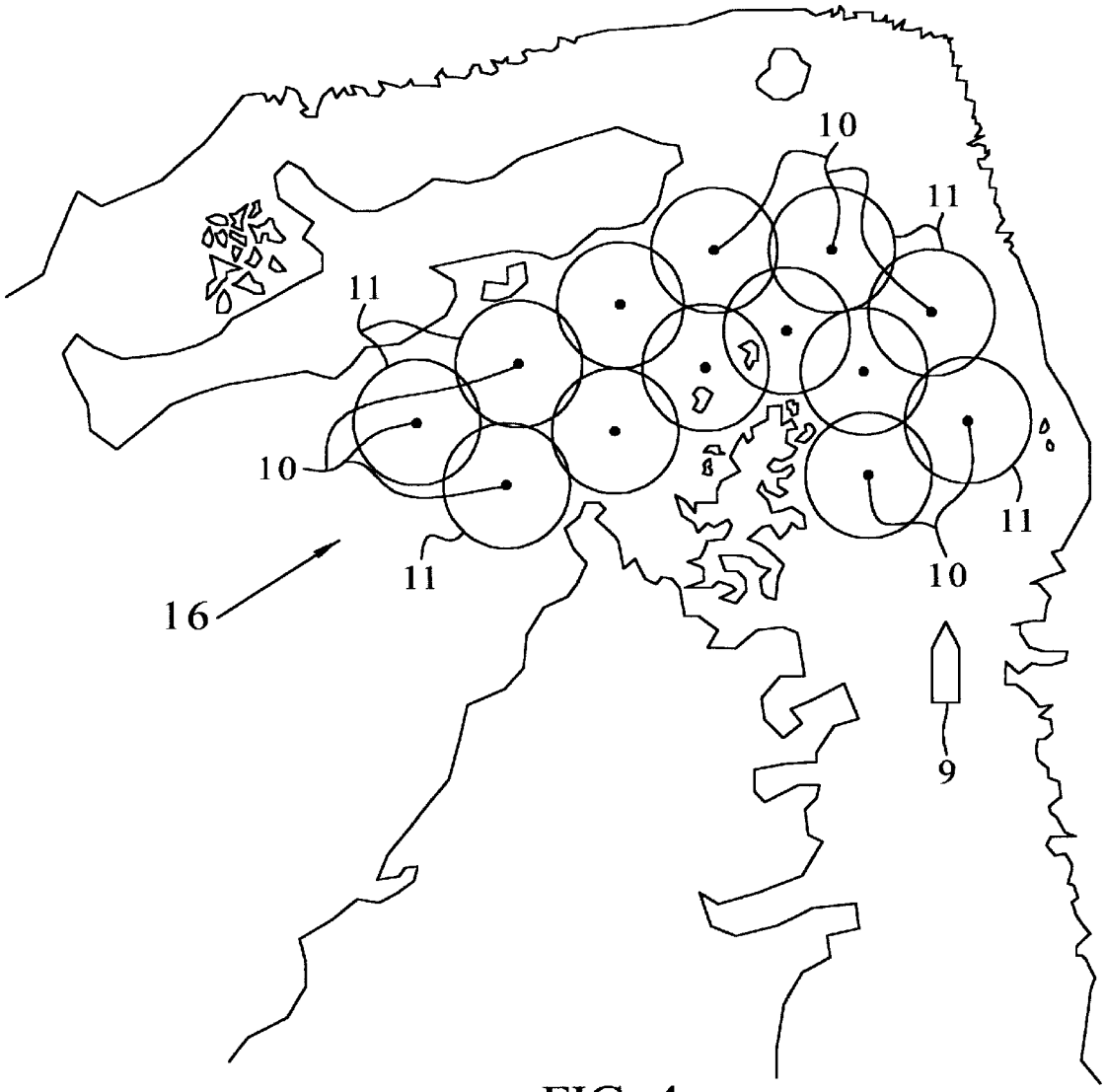
FIG. 4 schematically shows a plurality of devices of the invention creating overlapping areas of coverage to assure safe maneuvering and transit for a ship.

Referring to FIG. 4, a plurality of neutralization devices 10 can be deployed in a predetermined pattern or an array on bottom 7 of the ocean in areas 11 of overlapping coverage in a cleared passageway 16. Selectively activating different ones of devices 10 with different coded acoustic command signals AA from a remote source can neutralize mines 15 in specific areas and can reduce the possibly of alerting an adversary. The expanse of cleared passageway 16 gives sufficient room for ship 15 to safely maneuver in what could otherwise be a high-threat transit area where incoming ordnance is expected.

Figure 5:
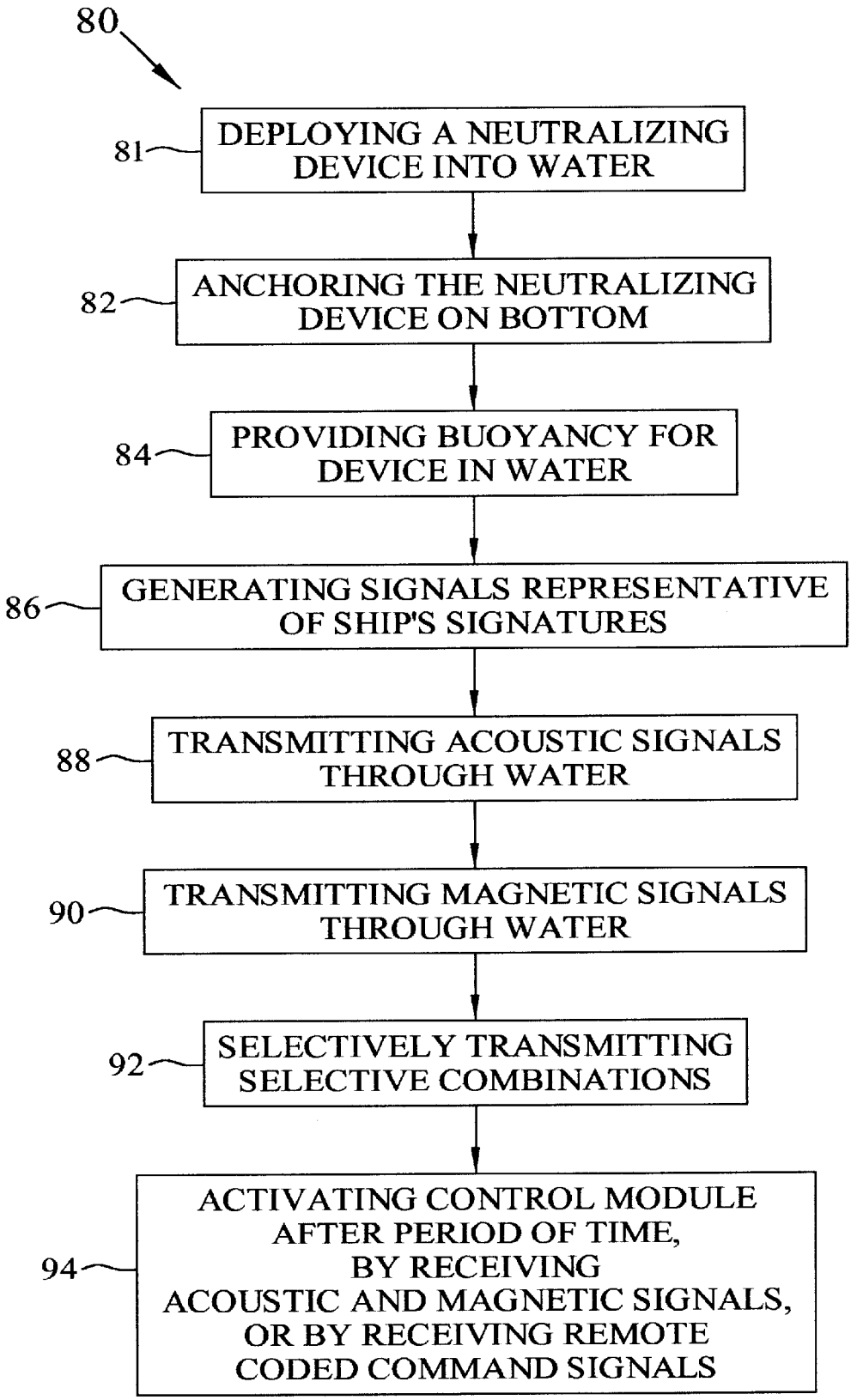
FIG. 5 schematically shows the method of the invention.

Referring to FIG. 5, the method 80 of neutralizing influence mine 15 first requires deploying 81 a neutralizing device 10 into water 9 in the area of mine 15, and anchoring 82 an electronics/control module 70, acoustic signal transmitter 20, and magnetic signal transmitter 30 of neutralizing device 10 to bottom 7 of a body of water 8. Providing buoyancy 84 to electronics/control module 70, acoustic signal transmitter 20, and magnetic signal transmitter 30 of neutralizing device 10 to orient them vertically from bottom 7 and suspend them in water 8 to enable generating signals 86 representative of acoustic and magnetic signatures of ship 9 in electronics/control module 70. Transmitting 88 acoustic signals 26 representative of the acoustic portion of the signatures of ship 9 through water 8, and transmitting 90 magnetic signals 36 representative of a magnetic portion of the signatures of ship 9 through water 8 assures detonation 91 of mine 15.

Transmission of the signature signals can be initiated by selectively transmitting 92 selective combinations of signals through water 8 by activating 94 control module 70 to generate the representative signals. Th representative signals can be generated in response to: 1.) the passage of a predetermined period of time; 2.) the receipt of acoustic and/or magnetic signals from an outside source; or 3.) the receipt of acoustic command signals from a remote source or vessel.

Optionally, a plurality of neutralizing devices 10 can be deployed in a pattern of overlapping coverage that will define a passageway for ship 9. Different ones of neutralizing devices 10 can be selectively activated with different coded acoustic command signals. This gives planners latitude to provide for safe passage without unduly alerting an adversary of passage of ship 9.

Device 10 of the invention can protect friendly ships by denying an adversary an area to lay a minefield. Device 10 neutralizes an area that already may be mined since it transmits ship signatures, thereby assuring friendly forces that a ship having the transmitted signatures will not set off any of the mines. Device 10 is small, lightweight, expendable, and is easily deployed from a number of different platforms and does not expose divers to dangers. Device 10 could be deployed before hostilities and remain hidden until acoustically activated. Device 10 is a cost-effective way to tie up resources of hostile forces if removal is attempted. Since device 10 may be intermittently activated, it can be difficult to locate and remove from an area.

The disclosed components and their arrangements as disclosed herein all contribute to the novel features of this invention. Device 10 of this invention provides a reliable and cost-effective means to neutralize mines of an adversary and assure safe transit of ships through the ocean. Therefore, device 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A device to neutralize influence mines comprising:

a control module having a first section to generate signals representative of an acoustic portion of signatures of a ship and a second section to generate signals representative of a magnetic portion of said signatures of said ship;

an acoustic transducer array coupled to said first section of said control module to transmit acoustic signals representative of said acoustic portion of said signatures;

a magnetic signal transmitter coupled to said second section of said control module to transmit magnetic signals representative of said magnetic portion of said signatures;

an anchor coupled to at least one of said control module, said acoustic transducer array, and said magnetic signal transmitter to anchor the device to a bottom of a body of water; and a buoy connected to at least one of said control module, said acoustic transducer array, and said magnetic signal transmitter to buoy the device upward and suspend the device in said body of water.

2. The device of claim 1 wherein said representative signals of said of said acoustic portion and said magnetic portion of said signatures assure transmission of selective combinations of acoustic signals and magnetic signals of said signatures through said water to detonate influence mines in an area.

3. The device of claim 2 wherein said suspended acoustic transducer array and magnetic signal transmitter transmit said acoustic and magnetic signals in a pattern through said water.

4. The device of claim 3 wherein:

said control module further comprises an energy source connected thereto;

said acoustic transmitting means is comprised of at least one acoustic transducer; and said magnetic signal transmitting means is comprised of at least one magnetic coil.

5. The device of claim 4 wherein said magnetic coil extends in a vertical orientation.

6. The device of claim 4 wherein said magnetic coil extends in a horizontal orientation.

7. A device to neutralize influence mines comprising:

a first control module having a section to generate signals representative of an acoustic portion of signatures of a ship;

a second control module having a section to generate signals representative of a magnetic portion of said signatures of said ship;

an acoustic transducer array including at least one acoustic transducer coupled to said first control module to transmit acoustic signals representative of said acoustic portion of said signatures;

a magnetic signal transmitter including at least one magnetic coil coupled to said second control module to transmit magnetic signals representative of said magnetic portion of said signatures;

a first anchor coupled to at least one of said first control module and said acoustic transducer array to anchor said first control module and said acoustic transducer array to a bottom of a body of water;

a first buoy connected at least one of to said first control module and said acoustic transducer array to buoy said first control module and acoustic transducer array upward in a suspended vertical orientation in the water;

a second anchor coupled to at least one of said second control module and said magnetic signal transmitter to anchor said second control module and said magnetic signal transmitter to the bottom; and a second buoy connected to at least one of said second control module and said magnetic signal transmitter to buoy said second control module and said magnetic signal transmitter upward in a suspended vertical orientation in the water.

* * * * *